United States Patent [19]

Davis

[11] 4,272,222

[45] Jun. 9, 1981

[54] BOOM APPARATUS

[75] Inventor: Charles J. Davis, Afton, Okla.

[73] Assignee: The General, Inc., Wichita, Kans.

[21] Appl. No.: 2,597

[22] Filed: Jan. 11, 1979

[51] Int. Cl.[3] ..... E02F 3/74

[52] U.S. Cl. ..... 414/694; 414/722; 37/103

[58] Field of Search ..... 414/694, 722, 727; 37/103, 117.5, 118

[56] References Cited

U.S. PATENT DOCUMENTS

| | | | |
|---|---|---|---|
| 3,204,792 | 9/1965 | Larson et al. | 414/694 |
| 3,251,490 | 5/1966 | Guinot | 414/694 |
| 3,376,984 | 4/1968 | Long et al. | 414/694 |
| 3,589,539 | 6/1971 | Witwer | 414/694 |
| 3,987,914 | 10/1976 | VanDerZyl et al. | 414/694 |
| 4,074,821 | 2/1978 | Long | 414/694 |
| 4,094,422 | 6/1978 | Thompson | 414/694 X |

FOREIGN PATENT DOCUMENTS

| | | | |
|---|---|---|---|
| 1948967 | 4/1971 | Fed. Rep. of Germany | 414/694 |

*Primary Examiner*—Leslie J. Paperner
*Assistant Examiner*—Terrance L. Siemens
*Attorney, Agent, or Firm*—Schmidt, Johnson, Hovey & Williams

[57] ABSTRACT

The vertically swingable boom of the apparatus is articulated to present a joint that is spaced outwardly from the horizontal swinging axis of the lift cylinder for the boom. A rigid link transversely and pivotally interconnects the lift cylinder and the inner section of the boom to control articulation of the latter about the joint during swinging of the boom. Consequently, the moment between the line of action of the lift cylinder and the boom remains favorably high at all locations on the path of swinging travel of the boom and the lift cylinder can swing through an arc approaching 180° during its operation of the boom.

8 Claims, 7 Drawing Figures

BOOM APPARATUS

TECHNICAL FIELD

This invention relates to boom apparatus and has particular but not exclusive utility in connection with digging equipment such as backhoes.

BACKGROUND ART

Booms used in lifting and/or digging have typically become more massive in recent years, but not necessarily more efficient or better performing. For example, it has become an industry standard to provide backhoes with the capability of digging to a depth of fourteen feet. In achieving that capability, many units have become so massive that they likewise require massive prime movers in order to provide counterbalance during roading or movement to varying locations at the job site. Inasmuch as the backhoes are typically attached to the rear ends of such prime movers at a location substantially rearwardly of the rear wheels thereof, a natural situation arises in which the rear wheels serve as a fulcrum point and the attached backhoe tends to rock the prime mover backwards unless sufficiently counterbalanced by structure at the front end of the prime mover.

This condition is aggravated in many backhoes by the fact that even when fully raised and folded for transport, the center of gravity of such units is well behind the vertical swiveling axis of the backhoe because the boom thereof extends upwardly and rearwardly from the prime mover.

Attempts have been made to alleviate this situation such as in Long et al. U.S. Pat. No. 3,376,984 in which the backhoe, when folded, has its boom disposed beyond vertical and leaning forwardly toward the prime mover so as to dispose the center of gravity of the backhoe closer to the fulcrum point presented by the rear ground wheels. The arrangement in said Patent, however, requires the hydraulic lift cylinders for the boom to reverse their strokes as the boom swings beyond vertical, a condition that is not only awkward to obtain but which also requires that the boom be slammed abruptly into its home position in order to have sufficient inertia to carry the same past vertical.

Furthermore, such an arrangement does nothing to alleviate the great bulk of the backhoe necessary to obtain the desired fourteen-foot digging depth. Hence, even when folded, the backhoe constructed according to said U.S. Pat. No. 3,376,984 presents a relatively high silhouette caused by excessive boom length, and the massive nature of the unit necessitates more powerful, massive prime movers to operate the same, all of which quite naturally results in greater fuel consumption, higher material costs and even larger trailering equipment in order to transport the unit from one job site to another over the road.

SUMMARY OF THE PRESENT INVENTION

In view of the above, one important object of the present invention is to provide a novel boom arrangement which exhibits a favorable moment between the boom itself and the line of action of its lift cylinder at all positions on the path of vertical swinging movement of the boom. Thus, if the invention is incorporated, for example, into a construction boom where heavy loads are handled, the present invention will enable the lift cylinder to maintain a favorable operating advantage on the boom even as the boom approaches true vertical.

When the invention is embodied in digging equipment such as a backhoe, the advantages of favorable moment maintenance are coupled with an expanded path of vertical swinging travel for the lift cylinder and the boom, this in itself giving rise to several distinct benefits. For example, it permits the production of a compact, relatively lightweight, yet powerful digging unit which can be folded into a low profile, 'storage condition in which the outer, primary section of the boom leans forwardly beyond vertical toward its prime mover without compromising the digging depth of the unit when fully unfolded.

In obtaining the above objects, the boom is articulated so as to present a joint between the inner and outer sections thereof. The joint is located in a position that is spaced outwardly from the point of pivoting attachment of the lift cylinder to the support for the boom, and a rigid link transversely and pivotally interconnects the lift cylinder and the inner section of the boom. Thus, the lift cylinder can swing through an arc that approaches an included angle of 180° without the line of action of the lift cylinder coinciding with the longitudinal axis of the boom.

When the boom is fully raised, the outer section thereof may lean forwardly past vertical toward the prime mover so as to shift the center of gravity of the backhoe closer to the rear ground wheels of the vehicle for stability purposes. On the other hand, when the lift cylinder swings the boom downwardly from its transport position for digging, the joint in the boom likewise is forced downwardly to move the same out of the way of the extending and downwardly swinging lift cylinder and to prevent the formation of an overcenter condition of the lift cylinder relative to the joint. This permits the lift cylinder to swing through an included angle approaching 180° between the transport position and a full digging depth position. Thus, the backhoe can be extended at a relatively steep angle when reaching full digging depth, to the end that the overall length of the boom can be reduced compared to those backhoes wherein the booms are not permitted to swing downwardly to such a steep degree.

DETAILED DESCRIPTION

Figure 1:
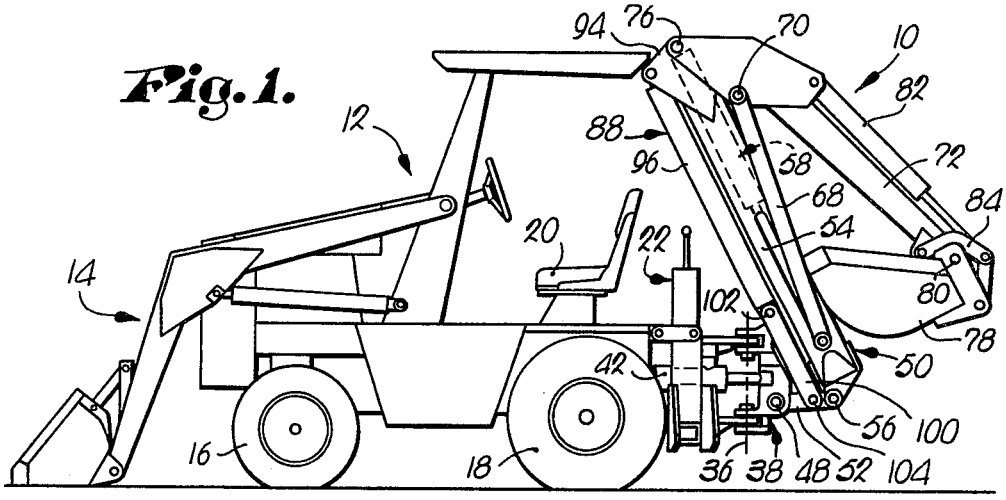
FIG. 1 is an elevational view of boom apparatus constructed in accordance with the principles of the present invention and embodied for purposes of illustration in a backhoe, the backhoe being disposed in its folded transport position at the rear of a prime mover.
Figure 3:
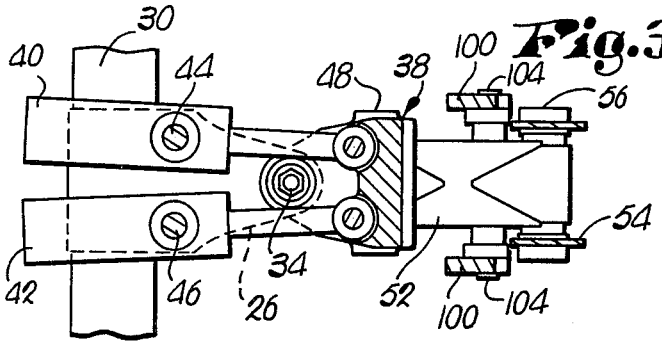
FIG. 3 is a generally horizontal cross-sectional view through the backhoe taken substantially along line 3—3 of FIG. 2.

As shown in FIG. 1, the present invention is embodied for purposes of illustration in a digging implement in the nature of a backhoe 10 mounted on the rear of a prime mover 12 which coincidentally is provided with a front end loader 14. The prime mover 12 is, of course, provided with front ground wheels 16 and rear ground wheels 18, with an operator's seat 20 that may be swiveled between the positions of FIGS. 1 and 4, and with controls 22 for operating backhoe 10.

The backhoe 10 is attached to the prime mover 12 by a pair of upper and lower, rearwardly extending plates 24 and 26 respectively secured at their forward ends to frame members 28 and 30 of the prime mover 12. The plates 24 and 26 are perforated at vertically aligned locations adjacent their rearmost ends so as to receive a pair of respective swivels 32 and 34 that define a common vertical axis of horizontal swiveling movement 36 for a rearwardly disposed supporting yoke 38. The yoke 38 may be swung from side to side about the axis 36 by a pair of hydraulic cylinder units 40 and 42 located on opposite lateral sides of the axis 36 and supported on the plates 24 and 26 by respective upright pivots 44 and 46.

The yoke 38 is provided with a lower horizontal pivot 48 to which the boom 50 of the backhoe 10 is attached for up and down swinging movement. The boom 50 is articulated and is thus provided with an inner section 52, an outer section 54, and a joint 56 therebetween defining a transverse horizontal axis about which sections 52 and 54 may articulate relative to one another. The outer section 54 is at least substantially tubular from one end to the opposite end thereof so as to house a double-acting, fluid-pressure, piston and cylinder unit 58 having a cylinder end 60 anchored at the outer end of the boom section 54 and a rod end 62 that is free to reciprocate longitudinally of the boom section 54 in response to the pumping of fluid into and out of the unit 58. As illustrated in detail in FIG. 7, the rod end 62 of unit 58 has transversely extending pintles 64 on opposite lateral sides thereof which project outwardly through and beyond longitudinal slots 66 in the sidewalls of the boom section 54, such pintles 64 in turn being connected to a pair of corresponding operating links 68.

The links 68 are pivotally connected at their distal ends by pivots 70 to the dipper stick member 72 of backhoe 10 comprising part of what may be generally referred to as digging apparatus 74 carried by the boom section 54. The dipper stick 72 has a horizontal pivot 76 with the boom section 54 at the outer end thereof in spaced relationship to the pivots 70 of operating links 68 such that, upon actuation of the cylinder 58 housed within boom section 54, the links 68 are caused to operate the dipper stick 72 about the pivot 76.

The digging apparatus 74 further includes a scooping bucket device 78 attached to the outer end of the dipper stick 72 by a horizontal pivot 80 and operated by a double-acting, fluid-pressure, piston and cylinder unit 82 in connection with leverage mechanism 84.

The boom 50 is operated by power means in the nature of a double-acting, fluid-pressure, piston and cylinder assembly 88 disposed along the upper wall of the boom section 54 and extending at least generally parallel thereto. The rod 90 of the cylinder assembly 88 is connected at its outer end to the outer boom section 54 by a pivot 92 on crank ears 94 rigidly secured to the boom section 54. On the other hand, the cylinder 96 of assembly 88 is connected at its inner end to an upper horizontal pivot 98 on the yoke 38 directly vertically above the lower horizontal pivot 48. Control means in the nature of a pair of side-by-side, rigid links 100 transversely and pivotally interconnect the piston and cylinder assembly 88 and the inner boom section 52, the links 100 being disposed on opposite lateral sides of the assembly 88 and each having an upper pivot 102 with the cylinder 96 at a location spaced outwardly from the upper pivot 98 and a lower pivot 104 with the inner boom section 52.

OPERATION

During digging, it is contemplated that suitable stabilizing outriggers (not shown) may be utilized adjacent the rear of the prime mover 12, such outriggers, of course, being raised out of a ground-engaging condition during transport. If desired, the front end loader 14 may be of some assistance also during digging, but likewise it is raised during transport.

Figure 2:
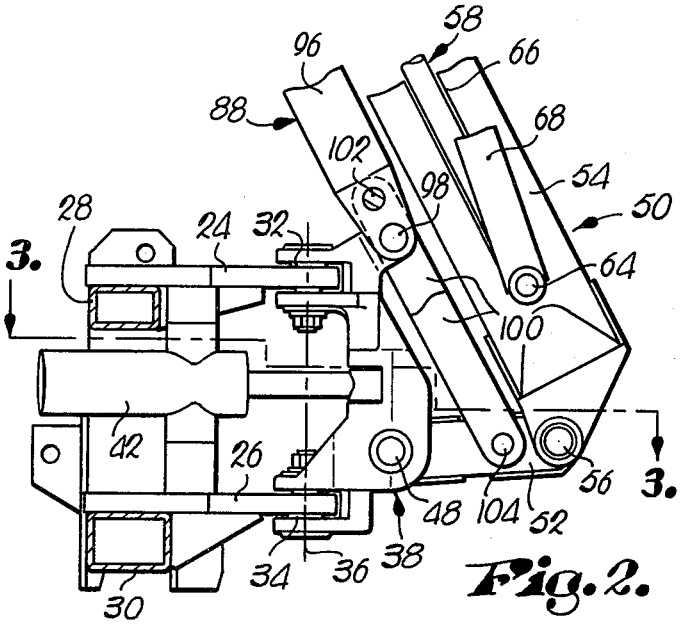
FIG. 2 is an enlarged, fragmentary, elevational view of the backhoe in its folded condition with parts shown in cross section and broken away to reveal details of construction.
Figure 6:
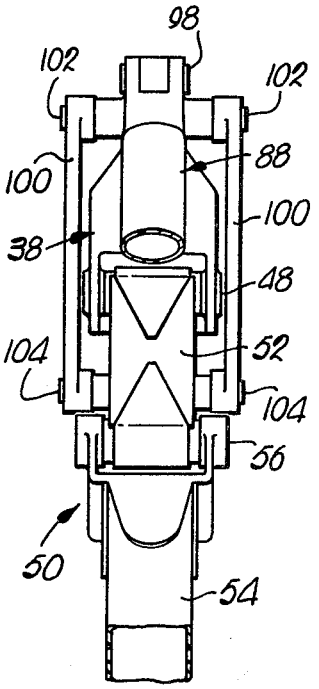
FIG. 6 is a fragmentary end elevational view of the backhoe taken substantially along line 6—6 of FIG. 5.
Figures 4, 5, 7:
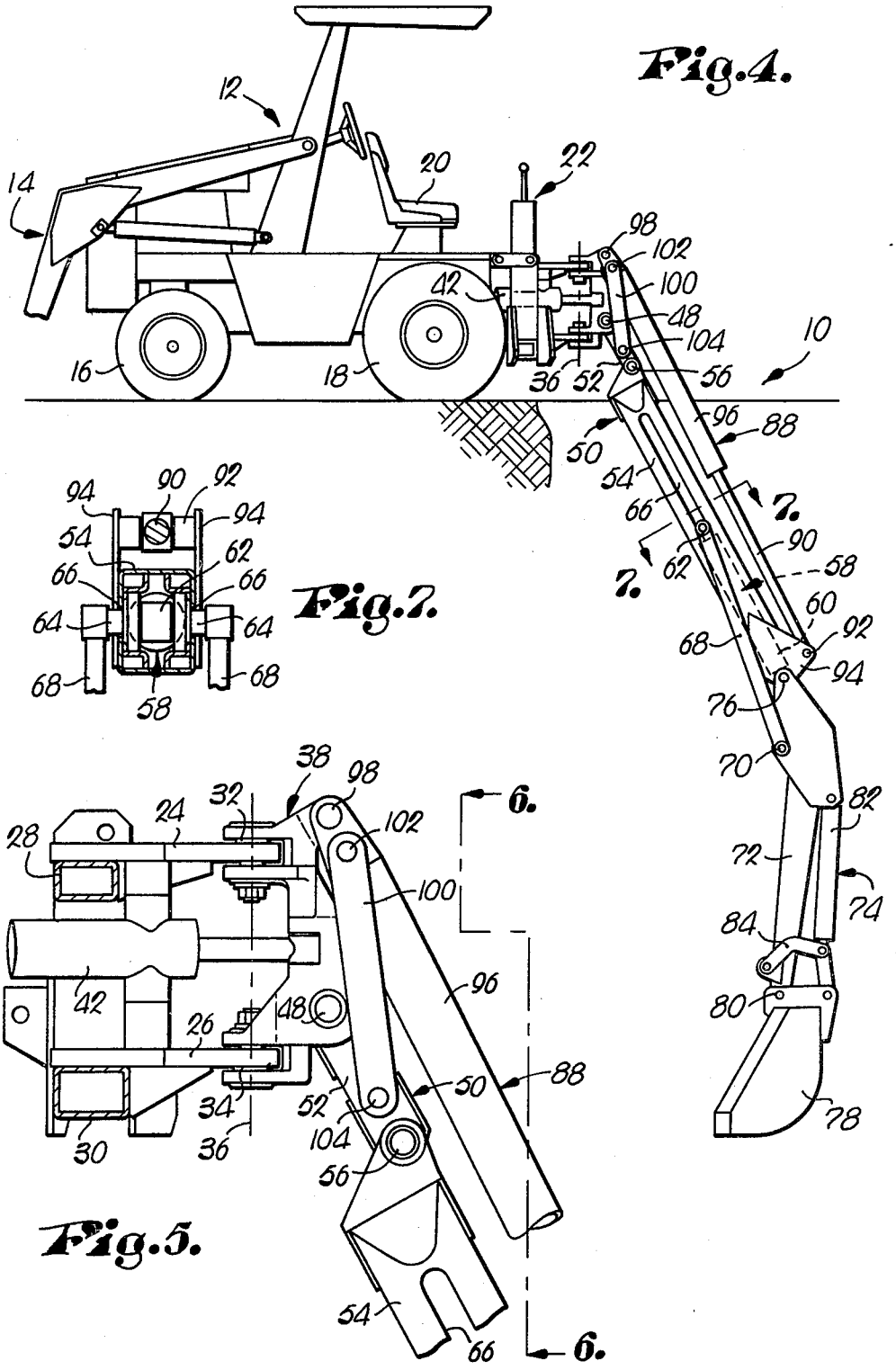
FIG. 4 is an elevational view of the backhoe and prime mover similar to FIG. 1 but with the backhoe shown at its full digging depth.
FIG. 5 is a fragmentary, elevational view of the backhoe similar to FIG. 2 but showing the same in its full digging attitude corresponding to the condition in FIG. 4.
FIG. 7 is a transverse, cross-sectional view through the boom and lift cylinder taken substantially along line 7—7 of FIG. 4.

FIGS. 1 and 4 (and correspondingly FIGS. 2 and 5) show the backhoe 10 in its two extreme positions of fully folded for transport purposes and fully extended for digging purposes at its fourteen-foot depth respectively. As illustrated in FIGS. 1 and 2, by virtue of the fact that joint 56 for the boom 50 is located outwardly of the upper pivot 98 for the assembly 88 (hereinafter lift cylinder 88), when the boom 50 is fully raised and folded, the outer boom section 54 is leaned forwardly beyond a vertical position toward the supporting yoke 38 such that the center of gravity of the backhoe 10 is much closer to the rear wheels 18 of the prime mover 12 than would otherwise be the case. The lift cylinder 88 is fully contracted at this time.

As the lift cylinder 88 is then extended, the boom 50 as a whole swings downwardly in a clockwise direction about the lower horizontal pivot 48. But at the same time, the outer boom section 54 articulates relative to the inner boom section 52 about the joint 56 so as to progressively unbuckle or straighten the joint 56 as the condition of things in FIGS. 4 and 5 is approached, it being understood that, of course, dipper stick 72 and scooping bucket 78 may likewise be actuated at this time through their respective cylinder units 58 and 82. As the outer boom section 54 thus articulates relative to the inner section 52, the latter is forced gradually downwardly by the rigid links 100 as the lift cylinder 88 likewise swings downwardly in a clockwise direction. This action necessarily clears the joint 56 out of the way of the lift cylinder 88 so that the latter can be disposed at a relatively steep downwardly and rearwardly inclined angle when full digging depth is reached as illustrated in FIGS. 4 and 5. It also prevents the lift cylinder 88 from moving into an over-center condition with respect to the joint 56. Thus, the lift cylinder 88 may be swung through an included arc between its transport and full digging depth positions that approaches 180°.

Note that when the lift cylinder 88 is in the steeply inclined position of FIGS. 4 and 5, there still exists a favorably substantial moment between the line of action of the lift cylinder 88 and the boom 50. Thus, the backhoe 10 has a powerful digging action even at full digging depth, as contrasted to typical prior backhoes wherein working power at full digging depth is compromised as a result of a minimal moment between the lift cylinder and the boom.

The impact of having the boom 50 articulated and controlled by the lift cylinder 88 and the links 100 in the manner hereinabove set forth is very significant. First, as above explained, it permits the backhoe 10 to be folded into a very compact, low-profile condition for transport wherein its center of gravity is favorably disposed at a position much closer to the rear ground wheels 18 than would otherwise be the case. This naturally results in greatly increased stability as the vehicle 12 is driven around the job site or on the open road.

Secondly, the above advantage is obtained without sacrificing digging depth and performance at such depth because the joint 56 moves down out of the way of the lift cylinder 88 as full digging depth is approached. Consequently, for any given combined overall length of the boom 50, the dipper stick 72 and the bucket 78 when fully extended, such given length can be projected steeply downwardly without limitation caused by the lift cylinder 88 striking structure defining the joint 56 or passing over center thereof.

Thirdly, because the joint 56 does indeed swing down to avoid interference with the lift cylinder 88 or prevent an over-center condition arising with respect thereto, the total combined length of the boom 50, the dipper stick 72 and the bucket 78 required to achieve a given digging depth (such as the fourteen-foot standard) can be less than that heretofore necessary. Consequently, the overall mass of the backhoe 10 can be reduced, its profile can be lowered when in a folded condition as illustrated in FIG. 1 so as to facilitate overhead clearance, and handling and transporting characteristics greatly improved, both from the standpoint of functionality and safety.

The boom apparatus of the present invention, as mentioned earlier herein, is usable in many types of equipment other than backhoes. For example, the invention might be incorporated into lifting cranes, in which event the fact that a favorable moment is maintained between the line of action of lift cylinder 88 and boom 50 at all vertical positions of the latter is of particular importance. With this in mind, it is apparent that the concepts of the present invention are not to be restricted to the particular embodiment chosen for purposes of illustration and should instead be limited only by the fair scope of the claims which follow.

I claim:

1. Boom apparatus including:

a support;

a boom mounted on said support for vertical swinging movement relative to the latter about a first horizontal axis;

power means between said support and said boom for effecting said movement of the latter, said power means being swingable about a second horizontal axis during said movement of the boom, said boom having a joint therein for articulation about a third horizontal axis spaced outwardly of said first and second axes; and means for controlling said articulation of the boom during said movement thereof, said control means comprising a rigid link pivotally connected between said power means and said boom.

2. Boom apparatus as claimed in claim 1, wherein said boom includes an inner section and an outer section on opposite sides of said joint, said power means being connected between said support and said outer section, said link being connected at one end with said power means and at the opposite end wiith said inner section.

3. Boom apparatus as claimed in claim 1, wherein said power means comprises a double-acting, fluid-pressure, piston and cylinder assembly.

4. Boom apparatus as claimed in claim 1, further including an elongated member having a pivotal connection with said boom outwardly of said joint; a digging device having a pivotal connection with said member outwardly of said connection of the latter with the boom; and mechanism for operating said member and said device about their respective pivotal connections.

5. Boom apparatus including:

a support;

a boom mounted on said support for vertical swinging movement relative to the latter about a first horizontal axis;

power means between said support and said boom for effecting said movement of the latter, said power means being swingable about a second horizontal axis during said movement of the boom, said boom having a joint therein for articulation about a third horizontal axis spaced outwardly of said first and second axes;

means for controlling said articulation of the boom during said movement thereof;

an elongated member having a pivotal connection with said boom outwardly of said joint;

a digging device having a pivotal connection with said member outwardly of said connection of the latter with the boom; and mechanism for operating said member and said device about their respective pivotal connections, said boom including an inner section and an outer section on opposite sides of said joint, said outer section being at least essentially tubular, said mechanism including a double-acting, fluid-pressure piston and cylinder unit housed within said outer section and further including a rigid operating link operably connecting the unit with the member.

6. In a backhoe, the improvement comprising:

a support provided with means for defining an upright axis of side-to-side swiveling movement of the backhoe;

a boom section having a horizontal pivot at the normally inner end thereof for up-and-down swinging movement of the boom section relative to the support;

rigid means pivotally connected between a lower point on said support and said horizontal pivot of the boom section for spacing said horizontal pivot outwardly from said support whereby the boom section may be leaned past a vertical position toward said support when the boom section is fully raised;

extendable and retractable power means pivotally connected between an upper point on said support and said boom section for effectng said up-and-down movement of the boom section; and means operably coupled with said rigid means for swinging said horizontal pivot of the boom section downwardly out of the path of travel of said power means as the latter swings downwardly during operation thereof to lower the boom section whereby to extend the reach of said boom section when fully lowered without compromising the ability of the boom section to be stored in its fully raised position leaning toward said support.

7. In a backhoe as claimed in claim 6, wherein said means operably coupled with said rigid means includes rigid link means pivotally connected between said power means and said rigid means.

8. In a backhoe as claimed in claim 7, wherein said power means includes a fluid-pressure piston and cylinder assembly extending along said boom section normally above the top side thereof, said link means comprising a pair of links on opposite lateral sides of said assembly and said rigid means.

* * * * *